US011707754B2

(12) United States Patent
Lee et al.

(10) Patent No.: US 11,707,754 B2
(45) Date of Patent: Jul. 25, 2023

(54) DOUBLE-WALLED CONTAINER

(71) Applicant: YONWOO CO., LTD., Incheon (KR)

(72) Inventors: Jae Ock Lee, Incheon (KR); Min Jae Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 17/791,044

(22) PCT Filed: Nov. 23, 2020

(86) PCT No.: PCT/KR2020/016588
§ 371 (c)(1),
(2) Date: Jul. 6, 2022

(87) PCT Pub. No.: WO2021/187718
PCT Pub. Date: Sep. 23, 2021

(65) Prior Publication Data

US 2023/0022130 A1 Jan. 26, 2023

(30) Foreign Application Priority Data

Mar. 16, 2020 (KR) ..... 10-2020-0031873

(51) Int. Cl.
*B05B 11/00* (2023.01)
*B05B 11/10* (2023.01)
(Continued)

(52) U.S. Cl.
CPC ..... *B05B 11/1047* (2023.01); *A45D 34/00* (2013.01); *A45D 40/00* (2013.01);
(Continued)

(58) Field of Classification Search
CPC ..... B05B 11/3047; A45D 34/00; A45D 40/00; A45D 34/005; B65D 77/06; B65D 83/0005
See application file for complete search history.

(56) References Cited

U.S. PATENT DOCUMENTS 6,309,124 B1 * 10/2001 Gueret ..... B65D 51/24 401/125
10,864,539 B2 * 12/2020 Delmon ..... B05B 11/0013
(Continued)

FOREIGN PATENT DOCUMENTS

JP 2004-307048 A 11/2004
JP 2008162632 A * 7/2008
(Continued)

*Primary Examiner* — Vishal Pancholi
(74) *Attorney, Agent, or Firm* — Bridgeway IP Law Group, PLLC; Sang Ho Lee; Hyun Woo Shin

(57) ABSTRACT

A double container includes: an inner container adapted to store a given content therein and having a neck formed on top thereof; an outer container adapted to accommodate at least a portion of the inner container therein; a neck cap coupled to the neck of the inner container and having at least a portion accommodated in the inner container; pump assemblies coupled to top of the outer container, detachably coupled to the outer peripheral surface of the neck cap, having at least portions accommodated in the neck cap and inserted inside the inner container, and adapted to discharge the content therefrom; and a nozzle adapted to be pressurized by a user to discharge the content transferred from the pump assemblies through a discharge hole.

7 Claims, 9 Drawing Sheets

(51) Int. Cl.

| | |
|---|---|
| ***A45D 34/00*** | (2006.01) |
| ***A45D 40/00*** | (2006.01) |
| ***B65D 77/06*** | (2006.01) |
| ***B65D 83/00*** | (2006.01) |

(52) U.S. Cl.
CPC ..... *B65D 77/06* (2013.01); *B65D 83/0005* (2013.01); *A45D 2034/005* (2013.01)

(56) References Cited

U.S. PATENT DOCUMENTS

| | | | | |
|---|---|---|---|---|
| 2008/0209857 | A1 | 9/2008 | Morini | |
| 2014/0144943 | A1* | 5/2014 | Kim | B05B 11/3097 222/256 |
| 2017/0000237 | A1* | 1/2017 | Lefevre | A45D 34/02 |
| 2017/0129690 | A1* | 5/2017 | Sugawara | B65D 83/62 |
| 2019/0060929 | A1* | 2/2019 | Delmon | B05B 11/0038 |

FOREIGN PATENT DOCUMENTS

| | | | |
|---|---|---|---|
| JP | 2010-006451 | A | 1/2010 |
| JP | 2012-106759 | A | 6/2012 |
| JP | 2018-122901 | A | 8/2018 |
| KR | 10-2018-0069003 | A | 6/2018 |

* cited by examiner

DOUBLE-WALLED CONTAINER

TECHNICAL FIELD

The present invention relates to a double container, and more specifically, to a double container that is capable of being simplified in coupling processes and being easily refilled with a content.

BACKGROUND ART

Generally, a content such as a cosmetic, and the like is stored in a container having given accommodation space and thus discharged by appropriate amount through an open outlet of the container, so that the content is applied directly to a user's skin or indirectly through a cosmetic tool to the user's skin.

For example, the content is filled in a contractible tube and then sold in the market, and if a cap coupled to the tube is removed from the tube to pressurize the outer surface of the tube in a compressive direction against the tube, a portion of the content may be discharged through an outlet formed on the end of the tube. However, in the case where the content is discharged by means of the pressurization of the tube itself, an amount of the content discharged may not be constant, thereby causing inconveniences in use.

To solve such a problem, accordingly, a pump container has been proposed. The pump container in which a given content is stored is configured to have a pump member coupled to top end thereof, so that through the control of the internal pressure of the pump member, the content stored in the pump container is sucked and discharged to the outside.

So as to allow the content of the pump container to be sucked by means of a negative pressure of the pump member coupled to the pump container and to allow the content inside the pump member to be discharged by means of a positive pressure to the outlet of the pump member, however, the pump container has to have a plurality of components coupled to one another, thereby causing a larger number of coupling processes than the existing tube and a high manufacturing cost.

In spite of the high manufacturing cost of the pump container, further, if the content is all consumed, the components of the pump container, such as the pump member, a nozzle, and the like may be all thrown away, without being recycled, which undesirably causes resource waste. Recently, therefore, a refillable product capable of filling the pump container again has been sold on the market, and in the case of the existing refillable product, initial filling of the content and a refill process are inconveniently performed. During the refill of the pump container, in specific, the content is exposed to an external environment so that it may be disadvantageously contaminated.

Accordingly, there is a need to develop a new pump container capable of being simplified in coupling processes and being refilled with a content more easily and sanitarily.

DISCLOSURE

Technical Problem

Accordingly, the present invention has been made in view of the above-mentioned problems occurring in the related art, and it is an object of the present invention to provide a double container that is capable of being simplified in coupling processes and being easily refilled with a content by means of a neck cap selectively detachable onto pump assemblies and an inner container.

The technical problems to be achieved through the present invention are not limited as mentioned above, and other technical problems not mentioned herein will be obviously understood by one of ordinary skill in the art through the following description.

Technical Solution

To accomplish the above-mentioned objects, according to the present invention, there is provided a double container. The double container may include: an inner container adapted to store a given content therein and having a neck formed on top thereof; an outer container adapted to accommodate at least a portion of the inner container therein; a neck cap coupled to the neck of the inner container and having at least a portion accommodated in the inner container; pump assemblies coupled to top of the outer container, detachably coupled to the outer peripheral surface of the neck cap, having at least portions accommodated in the neck cap and inserted inside the inner container, and adapted to discharge the content therefrom; and a nozzle adapted to be pressurized by a user to discharge the content transferred from the pump assemblies through a discharge hole.

Desirably, in a state of a first set in which the outer container, the neck cap, the pump assemblies, and the nozzle are coupled to one another, the inner container is inserted into the outer container through an open underside of the outer container to allow the neck cap to be fittedly coupled to the neck thereof.

Further, desirably, the pump assemblies may include: a screw cap detachably coupled to the outer peripheral surface of the neck cap; a pump coupled to the inside of the screw cap and having at least a portion accommodated in the inside of the neck cap to discharge the content therefrom; and a housing coupled to the outside of the screw cap and disposed on top of the outer container.

Further, desirably, the neck cap may include: a pump accommodation member for accommodating the at least portions of the pump assemblies therein; a first coupling member having at least a portion spaced apart from the outer peripheral surface of the pump accommodation member and adapted to fittedly insert the neck of the inner container thereinto; and a second coupling member formed on the outer peripheral surface of the neck cap and screw-coupled to the pump assemblies.

Also, desirably, at least one rotation prevention protrusion is formed on at least one of the inner peripheral surface of the first coupling member and the outer peripheral surface of the neck to prevent the neck cap from rotating when the pump assemblies rotate.

Moreover, desirably, if the pump assemblies rotate in a first direction, the coupling between the pump assemblies and the neck cap is released so that a third set in which the inner container and the neck cap are coupled to each other is separated from a second set in which the outer container, the pump assemblies, and the nozzle are coupled to one another.

Further, desirably, the pump assemblies and the outer container synchronizedly rotate unitarily.

Also, desirably, after the separation of the third set, a refill container filled with the content is inserted into the outer container through the open underside of the outer container and thus coupled to the second set.

Moreover, desirably, the refill container may include: a second inner container adapted to store the content therein and having a neck formed on top thereof; and a second neck cap coupled to the neck of the second inner container and having at least a portion accommodated in the second inner container, so that in a state where the second inner container is inserted into the outer container, if the pump assemblies rotate in a second direction opposite to the first direction, the pump assemblies are detachably coupled to the outer peripheral surface of the second neck cap.

Also, desirably, the refill container may further include a sealing cap detachably coupled to the outer peripheral surface of the second neck cap to seal the second inner container, and before the coupling to the second set, the sealing cap rotates in the first direction and is thus removed from the refill container.

Advantageous Effects

According to the present invention, the double container is configured to simply insert the inner container in which the content is filled into the assemblies of the components coupled to the outer container by means of the neck cap, thereby finishing the coupling of the components thereof and more simplifying the coupling processes of the product after the initial filling thereof.

According to the present invention, further, the double container is configured to allow the pump assemblies to rotate to thus separate the inner container and the neck cap as a unitary body therefrom and to allow the separated inner container and neck cap to be replaced with the refill container in a simply way to perform the refill, thereby improving the user's conveniences while in use and preventing the content from being contaminated.

DESCRIPTION OF DRAWINGS

To allow the drawings as will be mentioned in the description of the present invention to be more sufficiently understood, the brief description of the drawings may be provided.

MODE FOR INVENTION

Figure 1:
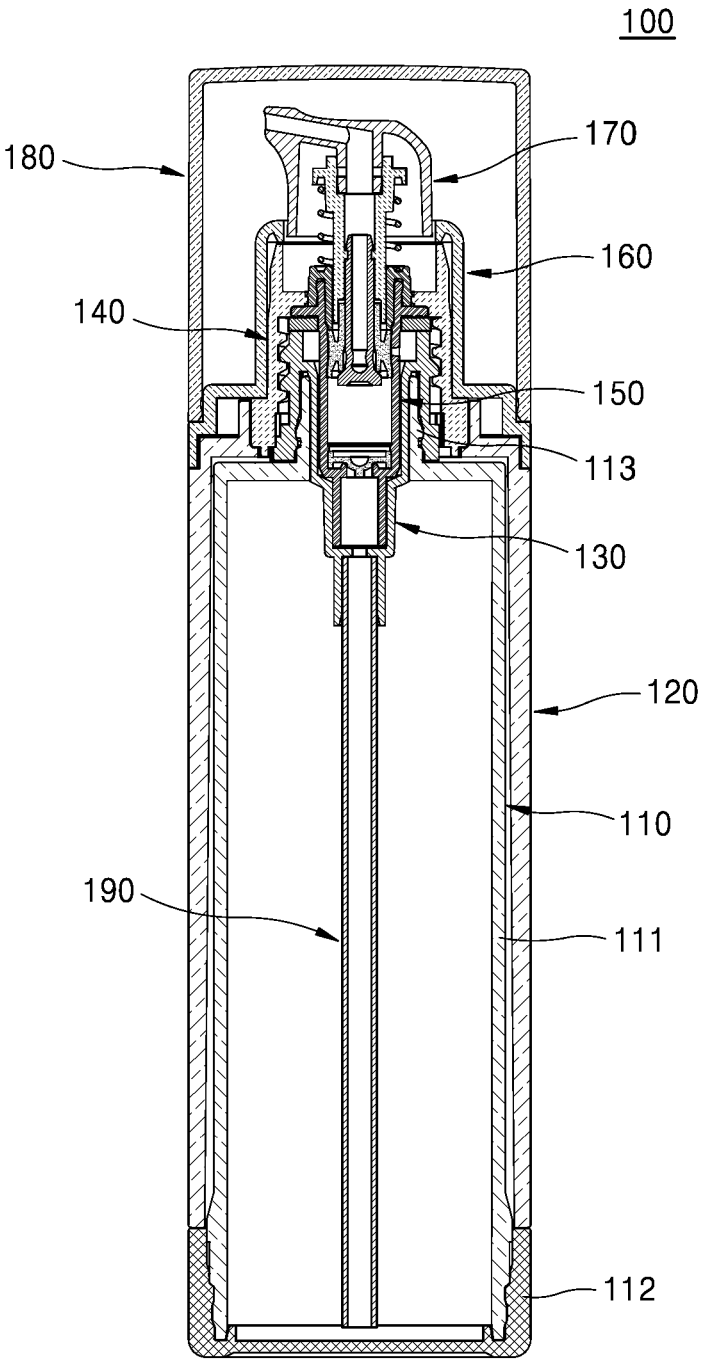
FIG. 1 shows a double container according to an embodiment of the present invention.

Hereinafter, example embodiments will be described with reference to the accompanying drawings; however, for reference numerals, with respect to the same elements, even though they may be displayed in different drawings, such elements use same reference numerals as much as possible. Also, in explaining the example embodiments, detailed description on known elements or functions will be omitted if it is determined that such description will interfere with understanding of the embodiments. In addition, the example embodiments may be embodied in different forms and should not be construed as limited to the embodiments set forth herein but may be modified and variously implemented by those skilled in the art. Further, top, bottom, left and right directions as will be described below are determined with reference to the drawings, and accordingly, the scope of the present invention is not necessarily restricted to the corresponding directions.

In the description, when it is said that one element is described as being "connected" to the other element, one element may be directly connected or coupled to the other element, but it should be understood that another element may be present between the two elements. When it is said that one portion is described as "includes" any component, further, one element may further include other components unless no specific description is suggested. Also, in explaining elements, terms like "first", "second", "A", "B", "(a)", "(b)", etc. may be used. However, such terms are used to distinguish one from the others only and they do not affect the essence, nature, sequence, order, etc.

Figure 2:
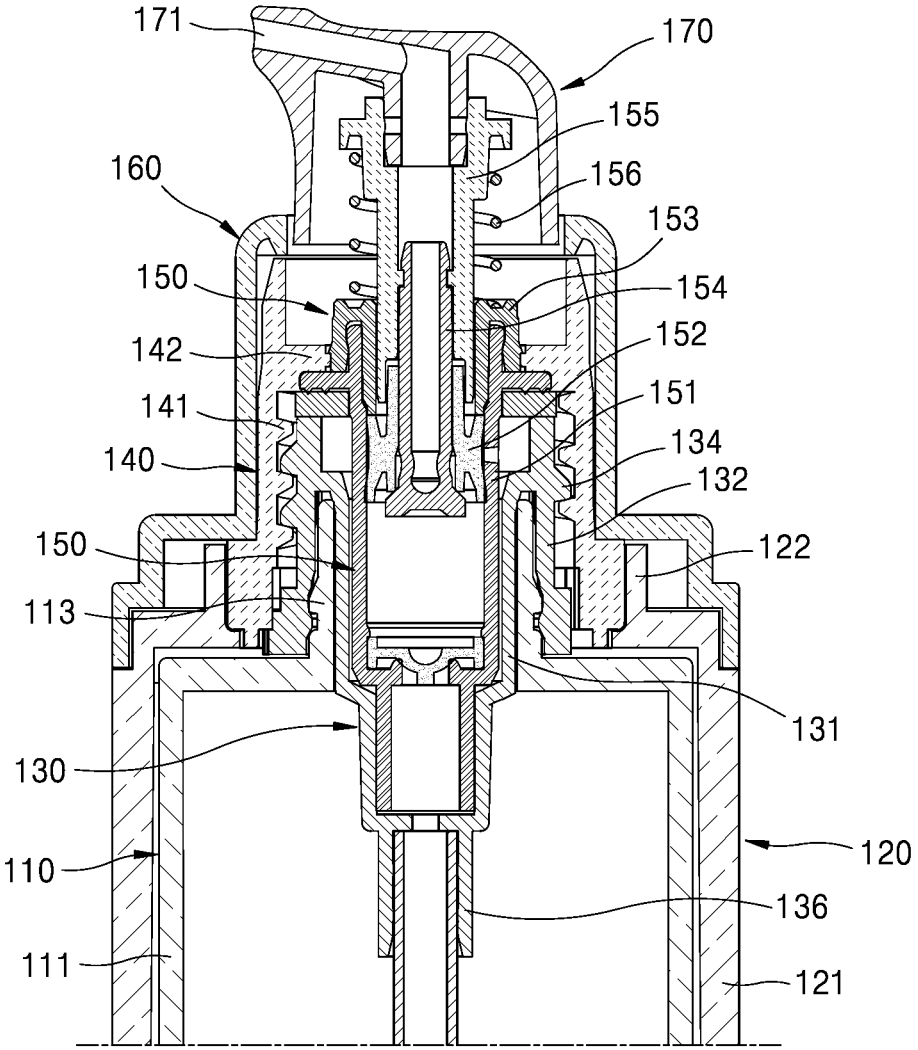
FIG. 2 shows an enlarged portion of FIG. 1.
Figure 3:
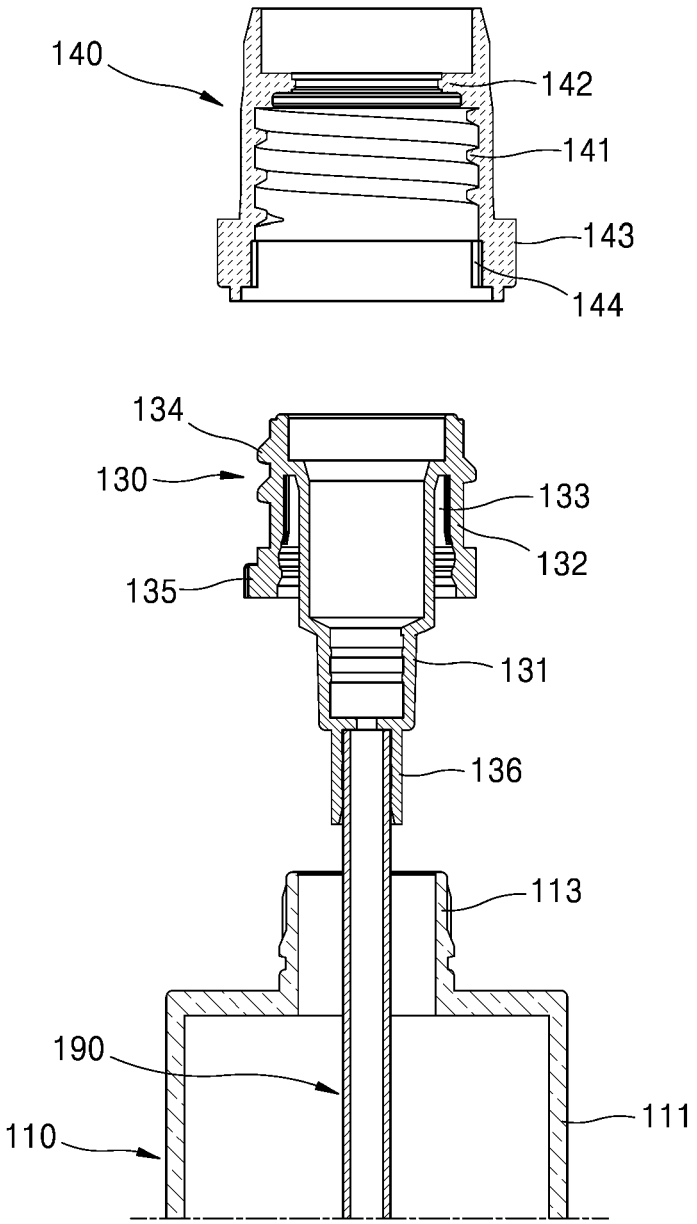
FIGS. 3 and 4 show an inner container, a neck cap and a screw cap of the double container according to the embodiment of the present invention.
Figure 4:
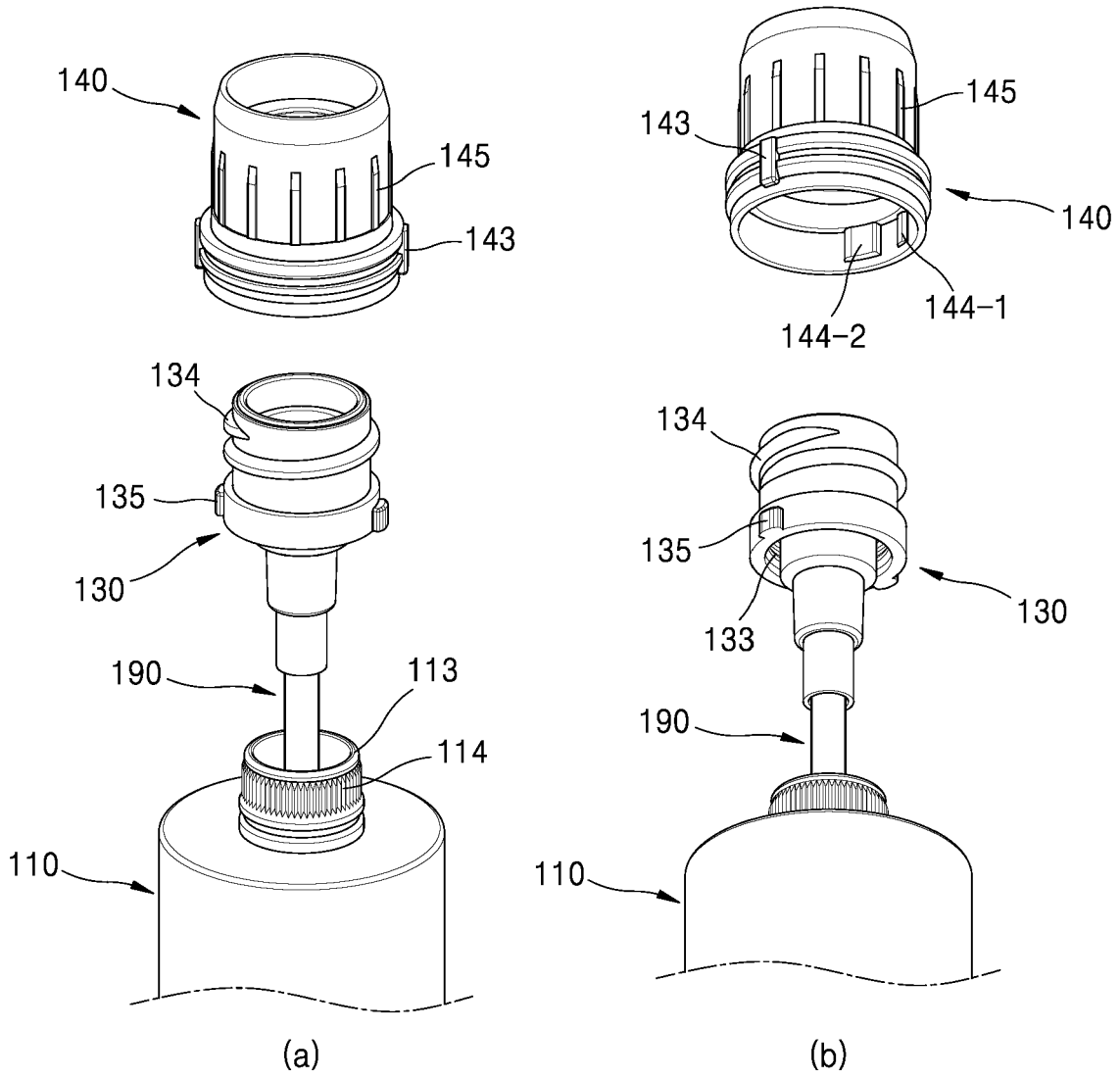

FIG. 1 shows a double container according to an embodiment of the present invention, FIG. 2 shows an enlarged portion of FIG. 1, and FIGS. 3 and 4 show an inner container, a neck cap and a screw cap of the double container according to the embodiment of the present invention.

Referring to FIGS. 1 to 4, a double container 100 according to an embodiment of the present invention includes containers 110 and 120, a neck cap 130, pump assemblies 140, 150, and 160, a nozzle 170, and an overcap 180.

The containers 110 and 120 are an inner container 110 and an outer container 120 constituting the double container 100. The inner container 110 stores a content therein and interlocks with the pump assemblies 140, 150, and 160 to apply the content to the outside of the double container 100, and the outer container 120 accommodates the inner container 110 in the inside thereof.

The inner container 110 includes a first accommodation member 111, a base 112, and a neck 113.

The first accommodation member 111 provides storage space for the content. As shown, it has a long cylindrical shape, but it may not be limited thereto. In this case, the content is a fluid of liquid or gel, which includes a cosmetic, a medicine, and a quasi-drug like tooth paste, but they are just exemplary, so that the content may include all kinds of materials capable of being discharged by means of pumping.

The base 112 is coupled to surround the lower end periphery of the first accommodation member 111 so that it can seal at least a portion of the open lower end periphery of the first accommodation member 111. For example, if the double container 100 is a dip tube pump type container, the base 112 is configured to completely seal the lower end periphery of the first accommodation member 111, and if the double container 100 is an airless pump type container, the base 112 is configured to have a given air inlet hole formed thereon so that the first accommodation member 111 communicates with external air. A coupling protrusion and a coupling groove and/or stepped projection may be formed on the outer peripheral surface of the first accommodation member 111 and/or the inner peripheral surface of the base 112 so as to fit the base 112 to the first accommodation member 111. However, they are just exemplary, and therefore, various structures may be provided to perform such coupling. According to the present invention, further, at least a portion of the base 112 is exposed to the outside to insert or draw the inner container 110 into or from the outer container 120.

The neck 113 extends upwardly from the top of the first accommodation member 111 and thus has a smaller inner diameter than the first accommodation member 111. Top of the neck 113 is open to allow the content to communicate with the pump assemblies 140, 150, and 160, and the neck 113 is sealed by means of coupling among the neck cap 130 and the pump assemblies 140, 150, and 160. Through the neck 113, accordingly, at least portions of the neck cap 130 and the pump assemblies 140, 150, and 160 are accommodated in the inner container 110.

The outer container 120 includes a second accommodation member 121 and an upper edge 122. The second accommodation member 121 provides accommodation space for locating the inner container 110 therein and has a cylindrical shape corresponding to the first accommodation member 111.

The outer container 120 is configured to have the second accommodation member 121 whose underside is open to thus accommodate the inner container 110 therein. As the inner container 110 is inserted into the outer container 120 through the open underside of the second accommodation member 121, the inner container 110 is accommodated inside the outer container 120. According to the present invention, further, an outer diameter of the second accommodation member 121 is the same as of the base 112 or is smaller than that of the base 112. When the inner container 110 is accommodated, accordingly, the lower end periphery of the second accommodation member 121 is seated onto top periphery of the base 112 so that the outer peripheral surface of the base 112 is exposed to the outside.

The upper edge 122 extends upwardly from top periphery of the second accommodation member 121 and thus has a smaller inner diameter than the second accommodation member 121. Top of the upper edge 122 is open so that the inner peripheral surface of the upper edge 122 is coupled to the pump assemblies (particularly, the screw cap 140). Through the coupling, if the pump assemblies 140, 150, and 160 rotate, the outer container 120 rotates together with the pump assemblies 140, 150, and 160.

The neck cap 130 is coupled to the neck 113 of the inner container 110, and at least a portion of the neck cap 130 is accommodated inside the inner container 110 through the neck 113. Further, at least portions of the pump assemblies 140, 150, and 160 are accommodated inside the neck cap 130, and in this case, the screw cap 140 among the pump assemblies 140, 150, and 160 is detachably coupled to the outer peripheral surface of the neck cap 130.

The neck cap 130 includes a pump accommodation member 131, a first coupling member 132, and a second coupling member 134.

The pump accommodation member 131 is open on top thereof to accommodate at least portions of the pump assemblies 140, 150, and 160 therein. For example, the pump accommodation member 131 has a shape corresponding to a cylinder 151 of the pump 150, inserts the lower portion of the cylinder 151 thereinto, and seats a wing of the cylinder 151 onto top end thereof. In this case, at least a portion of the underside of the pump accommodation member 131 is open to allow the content of the inner container 110 to communicate with the pump assemblies 140, 150, and 160.

The first coupling member 132 is fittedly coupled to the neck 113 of the inner container 110. For example, the first coupling member 132 is coupled to the outer peripheral surface of the pump accommodation member 131, while having at least a portion spaced apart from the outer peripheral surface of the pump accommodation member 131 to thus form insertion space 133 whose underside is open at the inside thereof. Accordingly, the neck 113 of the inner container 110 is fittedly inserted into the insertion space 133 so that the neck cap 130 is coupled to the neck 113 of the inner container 110. To perform such coupling, a coupling protrusion and a coupling groove and/or stepped projection may be formed on the inner peripheral surface of the first coupling member 132 and/or the outer peripheral surface of the neck 113, but they are just exemplary. Therefore, various structures may be provided to perform such coupling.

According to the present invention, at least one rotation prevention protrusion 114 may be formed on the inner peripheral surface of the first coupling member 132 and/or the outer peripheral surface of the neck 113. The rotation prevention protrusion 114 provides a given frictional force to the inner peripheral surface of the first coupling member 132 and/or the outer peripheral surface of the neck 113 so that the rotation prevention protrusion 114 prevents the neck cap 130 from rotating when the pump assemblies 140, 150, and 160 rotate for their coupling or separation.

The second coupling member 134 is disposed on the outer peripheral surface of the neck cap 130 to allow the pump assemblies 140, 150, and 160 to be detachably coupled thereto. For example, the second coupling member 134 has a shape of a screw thread on at least one outer peripheral surface of the pump accommodation member 131 and the first coupling member 132, and accordingly, the screw cap 140 among the pump assemblies 140, 150, and 160 is screw-coupled to the second coupling member 134.

According to the embodiment of the present invention, at least one or more locking protrusions 135 are formed protrudingly from the outer peripheral surface of the neck cap 130. When the neck cap 130 and the neck 113 are coupled to each other, the locking protrusions 135 are located close to the top end periphery of the first accommodation member 111 and then interlock with at least one or more locking protrusions 144 formed on the inner lower end periphery of the screw cap 140 to thus allow a user to recognize whether the pump assemblies 140, 150, and 160 are coupled to the neck cap 130.

The pump assemblies 140, 150, and 160 are detachably coupled to the outer peripheral surface (particularly, the second coupling member 134) of the neck cap 130, and at least portions thereof are accommodated in the neck cap 130 and inserted inside the inner container 110, thereby sealing the inner container 110. As the nozzle 170 is pressurized, after that, the pump assemblies 140, 150, and 160 transfer the content stored in the inner container 110 to the nozzle 170. For example, the pump assemblies 140, 150, and 160 represent the screw cap 140, the pump 150, and the housing 160.

The screw cap 140 is coupled to the outer peripheral surface of the pump 150 to fix the pump 150 thereto and detachably attached to the outer peripheral surface of the neck cap 130 coupled to the neck 113 of the inner container 110. For example, the screw cap 140 has a third coupling member 141 formed on the inner peripheral surface thereof to a shape of a screw thread corresponding to the second coupling member 134 of the neck cap 130, and as the pump assemblies 140, 150, and 160 rotate, the third coupling member 141 interlocks with the second coupling member 134 so that the screw cap 140 is detachably coupled to the neck cap 130. For example, if the screw cap 140 rotates in a first direction, it is separated from the neck cap 130, and if the screw cap 140 rotates in a second direction opposite to the first direction, it is screw-coupled to the neck cap 130.

The screw cap 140 has a fixing edge 142 protruding inwardly from the inner peripheral surface thereof. The fixing edge 142 is adapted to fix the pump 150 thereto and to downwardly pressurize the wing of the cylinder 151 if the screw cap 140 is coupled to the neck cap 130, so that the pump assemblies 140, 150, and 160 can be more stably coupled to the neck cap 130 and simultaneously air tightness among the inner container 110, the neck cap 130, and the pump assemblies 140, 150, and 160 can be more firmly achieved.

As the lower end periphery of the screw cap 140 is inserted into the inner peripheral surface of the upper edge 122 of the outer container 120, the pump assemblies 140, 150, and 160 are coupled to the outer container 120 so that they synchronizedly rotate with the outer container 120. To do this, at least one or more coupling protrusions 143 having a given shape are formed on the outer peripheral surface of the lower end of the screw cap 140, and coupling grooves (not shown) corresponding to the coupling protrusions 143 are concavely formed on the inner peripheral surface of the upper edge 122 of the outer container 120, so that the pump assemblies 140, 150, and 160 are coupled to the outer container 120 and thus synchronizedly rotate with the outer container 120.

Further, the screw cap 140 has the at least one or more locking protrusions 144 protruding inwardly from the inner peripheral surface of the lower end thereof. The locking protrusions 144 interlock with the locking protrusions 135 formed on the outer peripheral surface of the neck cap 130 to allow the user to recognize whether the pump assemblies 140, 150, and 160 are coupled to the neck cap 130 and to prevent the coupling from being arbitrarily released. According to the present invention, each locking protrusion 144 has a pair of first protrusion 144-1 and second protrusion 144-2 different in height. For example, the first protrusion 144-1 has a lower protruding height than the second protrusion 144-2, so that when the screw cap 140 rotates in the second direction, the first protrusion 144-1 provides a given resistance to the rotation of the screw cap 140, and as the locking protrusions 135 of the neck cap 130 are moved over the first protrusions 144-1 and then locked onto the second protrusions 144-2, next, the rotation in the second direction of the screw cap 140 is limited. In this case, each locking protrusion 135 of the neck cap 130 is accommodated between the first protrusion 144-1 and the second protrusion 144-2, and when the double container 100 is carried or kept at a given place, accordingly, the screw cap 140 can be prevented from being arbitrarily separated from the neck cap 130 through the rotation in the first direction.

Further, the screw cap 140 has a plurality of coupling protrusions 145 vertically formed on the outer peripheral surface of the upper portion thereof. The plurality of coupling protrusions 145 serves to fix the housing 160 to the outer peripheral surface of the screw cap 140. Accordingly, if the housing 160 is grasped by the user and thus rotates, the pump assemblies 140, 150, and 160 rotate unitarily.

The pump 150 communicates with the inner container 110 so that it transfers the content stored in the inner container 110 to the nozzle 170 in accordance with the pressurization of the nozzle 170. For example, the pump 150 includes the cylinder 151 having an inlet communicating with the interior of the inner container 110, a seal cap 152 disposed at the inner peripheral wall of the cylinder 151, a sealing member 153 coupled to the top end periphery of the cylinder 151 to suppress the seal cap 152 from rising, a piston rod 154 having an inlet formed on one end thereof and open and closed by means of the seal cap 152 and connected to a discharge hole 171 of the nozzle 170, a stem 155 coupled and elevated unitarily with the piston rod 154 and fitted to the inside of the nozzle 170, and an elastic member 156 for providing an elastic force in a direction toward the nozzle 170 from the sealing member 153. However, such a configuration of the pump 150 is just exemplary, and therefore, the pump 150 may be freely configured, without being limited thereto.

The pump 150 is fixed to the screw cap 140, and at least a portion of the pump 150 is accommodated in the neck cap 130. In specific, top end periphery of the cylinder 151 and/or the sealing member 153 are coupled to the fixing edge 142 of the screw cap 140, and at least a portion of the cylinder 151 is accommodated in the pump accommodation member 131 of the neck cap 130. In this case, the inlet of the cylinder 151 communicates with the open underside of the pump accommodation member 131, and as the nozzle 170 is pressurized, accordingly, the pump 150 sucks the content of the inner container 110 and transfers the sucked content to the nozzle 170.

The housing 160 is coupled to the outside of the screw cap 140 to surround the screw cap 140 and serves to accommodate the pump assemblies 140 and 150 as the screw cap and the pump therein to protect them from the outside.

The nozzle 170 transfers the external force applied from the user to the pump 150 and discharges the content discharged through the pump 150 to the outside. In specific, the nozzle 170 includes a nozzle tip for receiving the external force applied from the user, a flow path formed inside the nozzle tip to allow the content to communicate with the pump 150, and the discharge hole 171 for discharging the content from the flow path to the outside.

The overcap 180 is adapted to cover the nozzle 170 to prevent an accidental external force from being applied to the nozzle 170 and to protect the nozzle 170 from contamination. The overcap 180 is detachably coupled to the outer container 120 and/or the housing 160 among the pump assemblies 140, 150, and 160 and separated therefrom by means of the external force applied from the user. If the pump assemblies 140, 150, and 160 are separated from the neck cap 130 coupled to the inner container 110, the overcap 180 is separated from the inner container 110, together with the outer container 120, the pump assemblies 140, 150, and 160, and the nozzle 170. To improve the coupling force of the overcap 180, a stepped projection (having no reference numeral) and a locking projection (having no reference numeral) may be formed on the inner peripheral surface of the overcap 180 and/or the outer peripheral surface of the housing 160, but they are just exemplary. Therefore, various structures may be provided to perform the detachable coupling of the overcap 180.

According to the embodiment of the present invention, the double container 100 further includes a tube 190 communicating with the pump 150 to suck the content of the inner container 110. To do this, the neck cap 130 further includes a tube coupling portion 136. The tube coupling portion 136 extends downwardly from the pump accommodation member 131 and communicates with the interior of the pump accommodation member 131, and if the tube 190 is fittedly coupled to the tube coupling portion 136, the inlet of the cylinder 151 accommodated in the inside of the pump accommodation member 131 communicates with the tube 190, so that as the nozzle 170 is pressurized, the tube 190 sucks the content of the inner container 110 and transfers the sucked content to the nozzle 170.

Figure 5:
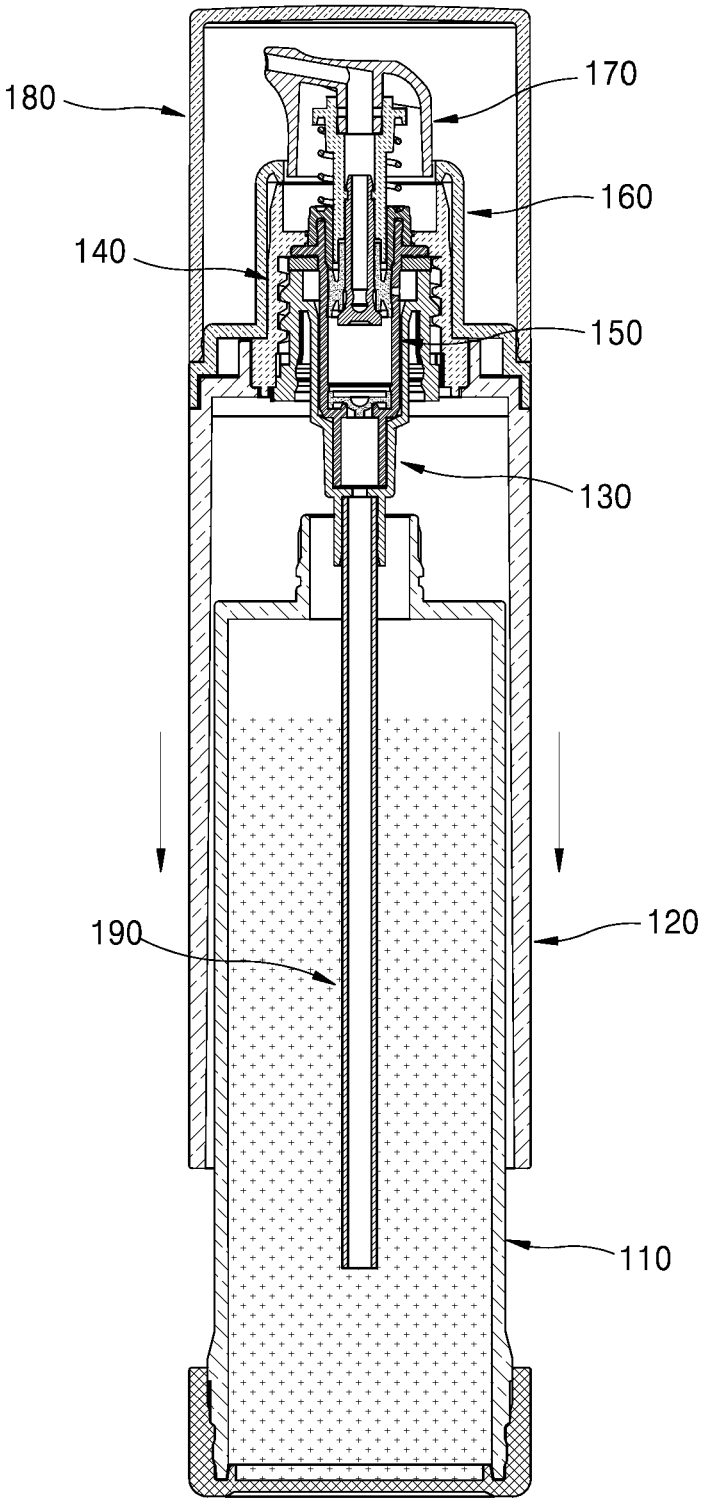
FIGS. 5 and 6 show examples of use of the double container according to the embodiment of the present invention.
Figure 6:
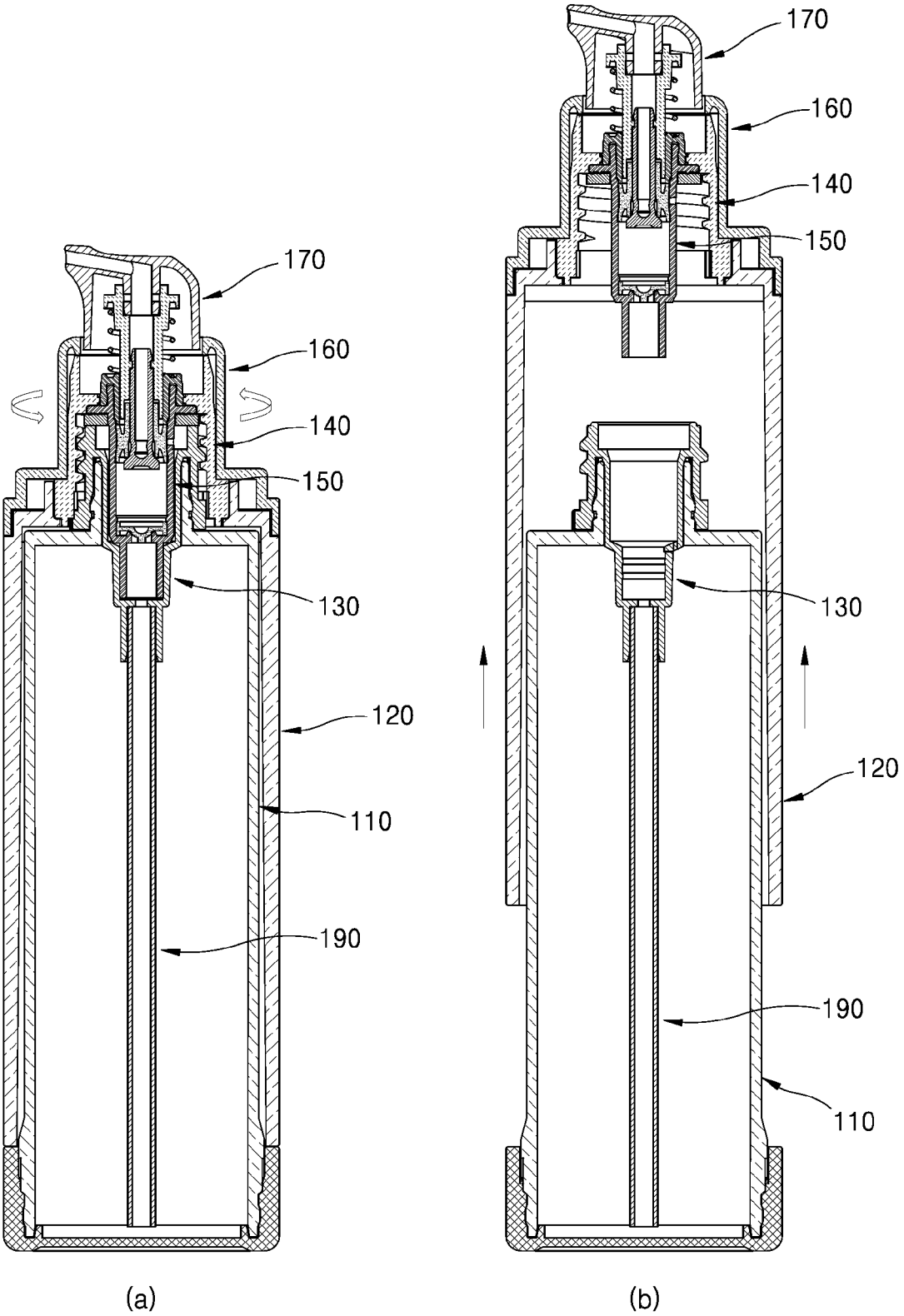

FIGS. 5 and 6 show examples of use of the double container according to the embodiment of the present invention.

In specific, FIG. 5 shows a process of coupling the components of the double container 100 after the content has been first filled in the inner container 110, and FIG. 6 shows a process of separating the inner container 110 from the double container 100 after the content has been consumed.

Referring to FIG. 5, the inner container 110 in which the content is first filled is inserted into the open underside of the outer container 120, thereby providing the double container 100.

In this case, the outer container 120, the neck cap 130, the pump assemblies 140, 150, and 160, and the nozzle 170 are coupled to one another to provide a first set. According to embodiments of the present invention, further, the overcap 180 and/or the tube 190 are coupled to the first set.

If the inner container 110 in which the content is first filled is inserted into the open underside of the outer container 120, the neck cap 130 and at least portions of the pump assemblies 140, 150, and 160 accommodated in the neck cap 130 are inserted into the inner container 110, and the neck 113 of the inner container 110 is fittedly coupled to the interior of the first coupling member 132 of the neck cap 130, thereby providing the double container 100.

Referring to FIG. 6, if the content of the inner container 110 is consumed, the pump assemblies 140, 150, and 160 and/or the outer container 120 rotate in the first direction to separate the inner container 110 and the neck cap 130 therefrom.

For example, if the housing 160 among the pump assemblies 140, 150, and 160 and/or the outer container 120 rotate in the first direction with respect to the inner container 110, the coupling among the pump assemblies (particularly, the screw cap 140) and the neck cap 130 may be released. Next, as the inner container 110 is drawn from the open underside of the outer container 120, a third set in which the inner container 110 and the neck cap 130 are coupled to each other is separated from a second set in which the outer container 120, the pump assemblies 140, 150, and 160, and the nozzle 170 are coupled to one another.

Hereinafter, a refill container in which the content is stored is coupled to the second set so as to refill the double container 100 with the content, which will be explained with reference to FIG. 8.

Figure 7:
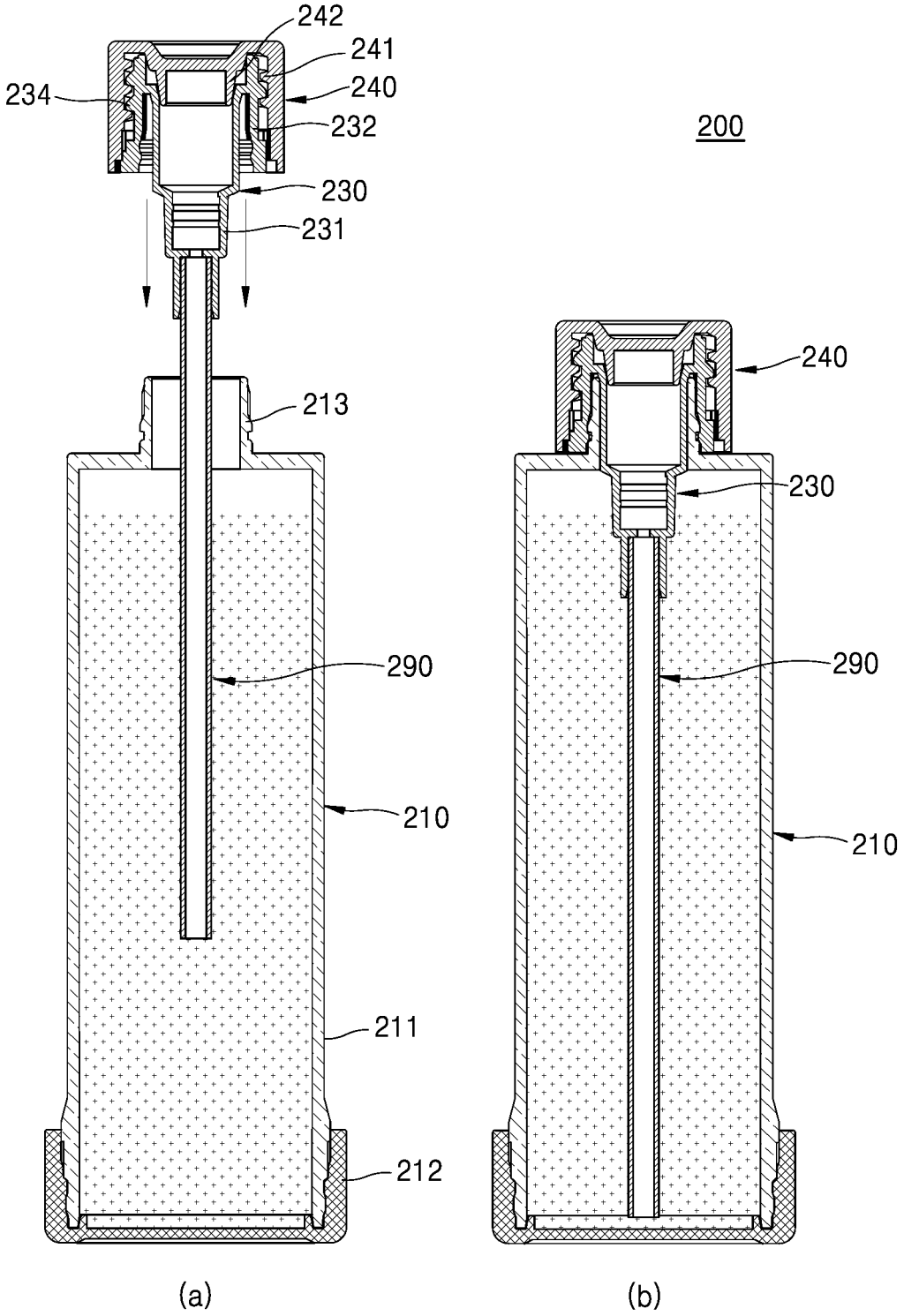
FIG. 7 shows a refill container according to the embodiment of the present invention.

FIG. 7 shows a refill container according to the embodiment of the present invention.

Referring to FIG. 7, a refill container 200 includes a second inner container 210, a second neck cap 230, and a sealing cap 240, and according to embodiments of the present invention, further, the refill container 200 may include a tube 290.

In this case, the second inner container 210, the second neck cap 230, and the tube 290 have the same configuration as the inner container 110, the neck cap 130, and the tube 190 as mentioned above with reference to FIGS. 1 to 6.

The sealing cap 240 is detachably coupled to the outer peripheral surface of the second neck cap 230 and serves to seal the second inner container 210. The sealing cap 240 further includes a fourth coupling member 241 formed on the inner peripheral surface thereof and screw-coupled to a second coupling member 234 formed on the outer peripheral surface of the second neck cap 230. For example, the fourth coupling member 241 has a shape of a screw thread corresponding to the second coupling member 234 of the second neck cap 230. Further, the sealing cap 240 includes an extension portion 242 protruding downwardly from the inner top thereof. The extension portion 242 is inserted into the top end of a pump accommodation member 231 of the second neck cap 230 so that at least one area thereof comes into close contact with the inner peripheral surface of the pump accommodation member 231.

The second inner container 210 is sealed by unitarily coupling the sealing cap 240 and the second neck cap 230 to a neck 213. For example, in a state where the sealing cap 240 is coupled to the outer peripheral surface of the second neck cap 230, the tube 290 and the second neck cap 230 are inserted into the second inner container 210 through the neck 213, and the neck 213 is fittedly coupled to a first coupling member 232 of the second neck cap 230, so that the second inner container 210 is sealed.

Figure 8:
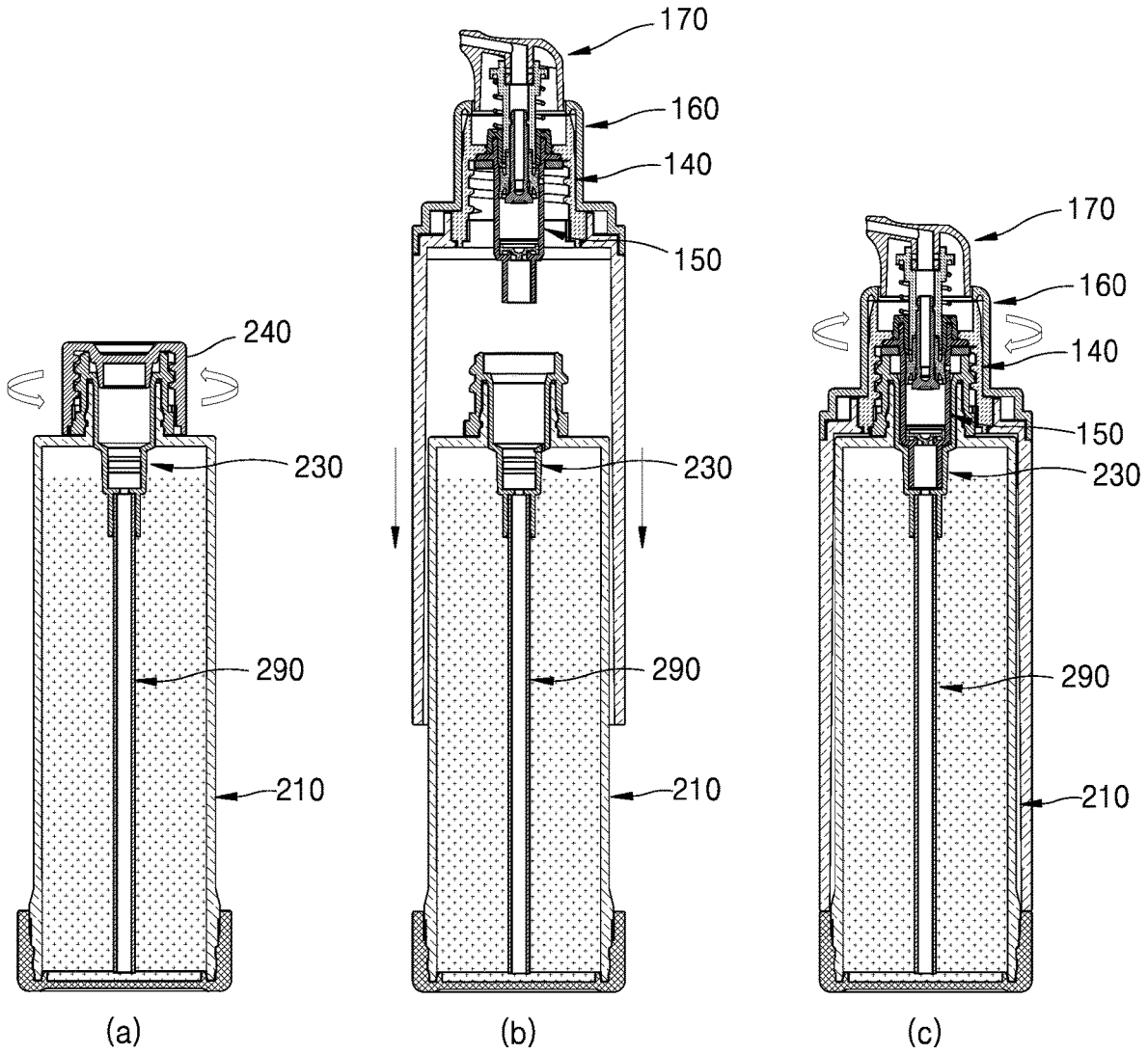
FIG. 8 shows examples of use of the refill container in the double container according to the embodiment of present invention.

FIG. 8 shows examples of use of the refill container in the double container according to the present invention.

In specific, FIG. 8 shows a process of coupling the refill container as shown in FIG. 7 to the second set of the double container 100 to refill the double container 100. In this case, as mentioned above, the second set is configured to couple the outer container 120, the pump assemblies 140, 150, and 160, and the nozzle 170 to one another.

Referring first to FIG. 8*a*, the sealing cap 240 rotates in the first direction and is thus removed from the refill container 200 before the refill container 200 is coupled.

Referring next to FIG. 8*b*, the second inner container 210 coupled to the second neck cap 230 is inserted into the outer container 120 through the open underside of the outer container 120. Accordingly, the second inner container 210 is accommodated in the outer container 120, and the pump 150 is accommodated in the pump accommodation member 231 of the second neck cap 230 and thus inserted into the second inner container 210.

Referring to FIG. 8*c*, after that, the pump assemblies 140, 150, and 160 and/or the outer container 120 rotate in the second direction with respect to the second inner container 210, and accordingly, the second coupling member 234 of the second neck cap 230 is screw-coupled to the third coupling member 141 of the screw cap 140.

Through such processes, the double container 100 can be refilled with the content easily and sanitarily.

Figure 9:
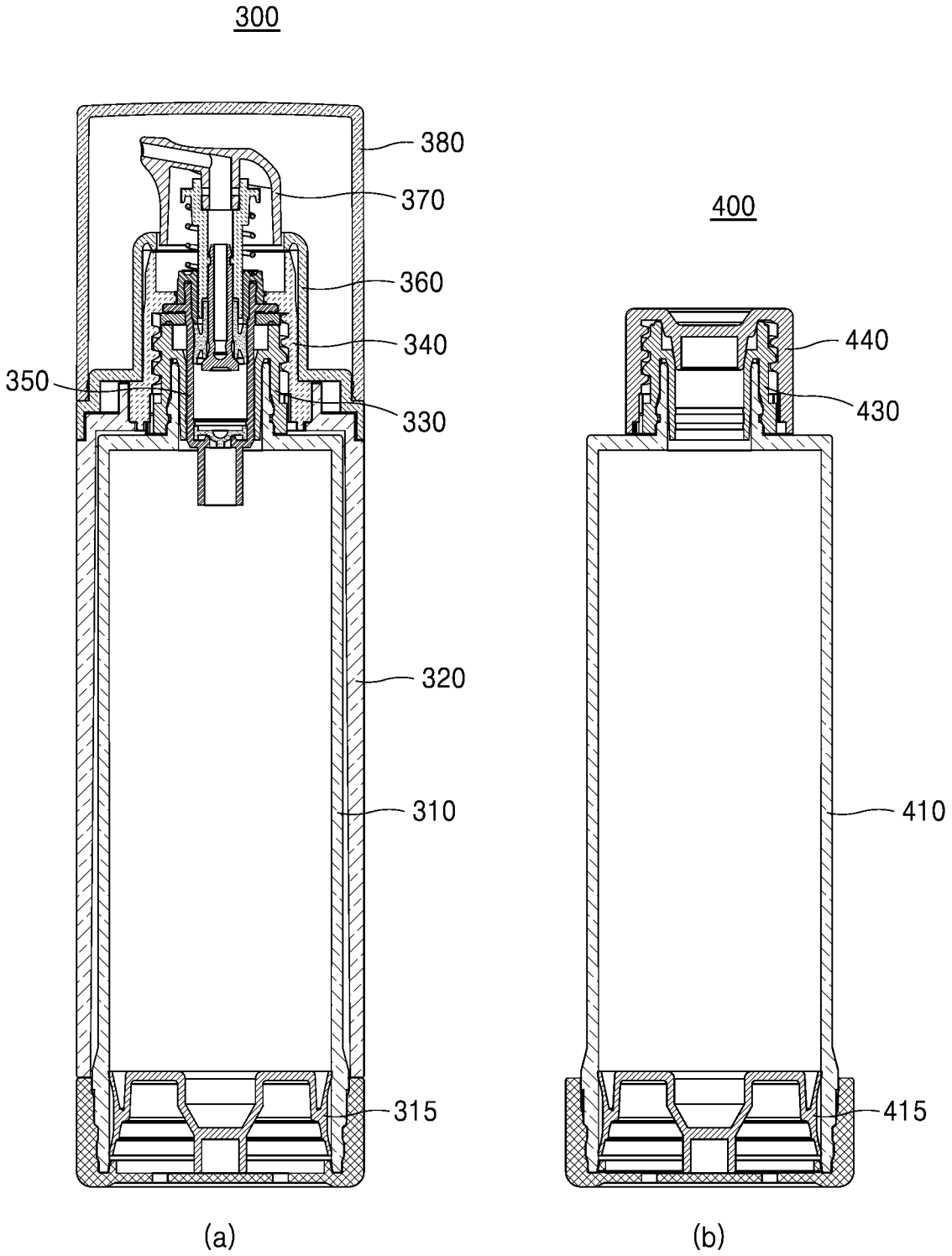
FIG. 9 shows a double container and a refill container according to another embodiment of the present invention.

FIG. 9 shows a double container and a refill container according to another embodiment of the present invention.

A double container 300 and a refill container 400 as shown in FIG. 9 have similar configurations to the double container 100 and the refill container 200 as shown FIGS. 1 to 8, and in this case, differences between the embodiments of the present invention will be discussed below.

Referring to FIG. 9*a*, the double container 300 is configured to allow the cylinder of a pump 350 to be exposed to the open underside of a neck cap 330 so that the cylinder directly communicates with an inner container 310.

Further, the double container 300 includes a disc 315 disposed inside the inner container 310. The disc 315 serves to push the content upwardly as the content stored in the inner container 310 becomes consumed, and in specific, the disc 315 is kept to come into close contact with the inner peripheral wall of the inner container 310, so that as the content is discharged to decrease in volume in the inner container 310, the disc 315 moves up.

To allow the disc 315 to move up gently, given air inlet holes (having no reference numeral) are formed on the underside of the inner container 310 (particularly, the underside of the base). If the disc 315 moves up by an amount of the content discharged, air is introduced into the inner container 310 through the air inlet holes. Like this, the content of the inner container 310 is stored in the state of being blocked from external air by means of the disc 315, and in this case, accordingly, the pump 350 of the double container 300 is an airless pump.

Referring to FIG. 9*b*, the refill container 400 includes a second neck cap 430 having the same configuration as the neck cap 330, and a sealing cap 440 is screw-coupled to the outer peripheral surface of the second neck cap 430. A second inner container 410 in which the content is stored has the same configuration as the inner container 310 and is sealed by fittedly coupling the second neck cap 430 coupled to the sealing cap 440 to the neck thereof. Like the inner container 310, further, the second inner container 410 includes a disc 415 disposed at the inside thereof and given air inlet holes (having no reference numeral) formed on the underside thereof.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. It should be therefore understood that the embodiments of the present invention are just exemplary embodiments, while not limiting the present invention. Persons skilled in the relevant art can appreciate that many modifications and variations are possible in light of the above teachings. It is therefore intended that the scope of the invention be limited not by this detailed description, but rather by the claims appended hereto.

The invention claimed is:

1. A double container comprising:

an inner container adapted to store content therein and having a neck formed on a top thereof;

an outer container adapted to accommodate at least a portion of the inner container therein;

a neck cap coupled to the neck of the inner container and having at least a portion thereof accommodated in the inner container;

pump assemblies coupled to a top of the outer container, detachably coupled to an outer peripheral surface of the neck cap, having at least portions thereof accommodated in the neck cap and inserted inside the inner container, and adapted to discharge the content therefrom; and a nozzle adapted to be pressurized by a user to discharge the content transferred from the pump assemblies through a discharge hole, wherein in a state of a first set in which the outer container, the neck cap, the pump assemblies, and the nozzle are coupled to one another, the inner container is inserted into the outer container through an open underside of the outer container and the neck of the inner container is fittedly coupled to an inner portion of the neck cap, wherein when the pump assemblies rotate in a first direction, the coupling between the pump assemblies and the neck cap is released, and a third set in which the inner container and the neck cap are coupled to each other is separated from a second set in which the outer container, the pump assemblies, and the nozzle are coupled to one another, and wherein the pump assemblies and the outer container synchronizedly rotate unitarily.

2. The double container according to claim 1, wherein the pump assemblies comprise:

a screw cap detachably coupled to the outer peripheral surface of the neck cap;

a pump coupled to an inside of the screw cap and having at least a portion thereof accommodated in an inside of the neck cap to discharge the content therefrom; and a housing coupled to an outside of the screw cap and disposed on the top of the outer container.

3. The double container according to claim 1, wherein the neck cap comprises:

a pump accommodation member for accommodating the at least portions of the pump assemblies therein;

a first coupling member having at least a portion thereof spaced apart from an outer peripheral surface of the pump accommodation member and adapted to fittedly insert the neck of the inner container thereinto; and a second coupling member formed on the outer peripheral surface of the neck cap and screw-coupled to the pump assemblies.

4. The double container according to claim 3, wherein at least one rotation prevention protrusion is formed on at least one of an inner peripheral surface of the first coupling member and the outer peripheral surface of the neck to prevent the neck cap from rotating when the pump assemblies rotate.

5. The double container according to claim 1, wherein after the separation of the third set, a refill container filled with the content is inserted into the outer container through the open underside of the outer container and coupled to the second set.

6. The double container according to claim 5, wherein the refill container comprises:

a second inner container adapted to store the content therein and having a neck formed on a top thereof; and a second neck cap coupled to the neck of the second inner container and having at least a portion thereof accommodated in the second inner container, wherein in a state where the second inner container is inserted into the outer container, when the pump assemblies rotate in a second direction opposite to the first direction, the pump assemblies are detachably coupled to an outer peripheral surface of the second neck cap.

7. The double container according to claim 6, wherein the refill container further comprises a sealing cap detachably coupled to the outer peripheral surface of the second neck cap to seal the second inner container, and before the coupling to the second set, the sealing cap rotates in the first direction and is removed from the refill container.

* * * * *